US006642907B2

(12) United States Patent
Hamada et al.

(10) Patent No.: US 6,642,907 B2
(45) Date of Patent: Nov. 4, 2003

(54) ANTENNA DEVICE

(75) Inventors: Hiroki Hamada, Tokyo (JP); Masayuki Ishiwa, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 10/044,069

(22) Filed: Jan. 9, 2002

(65) Prior Publication Data

US 2002/0093457 A1 Jul. 18, 2002

(30) Foreign Application Priority Data

Jan. 12, 2001 (JP) ..... 2001-005029

(51) Int. Cl.[7] ..... H01Q 1/38; H01Q 1/40

(52) U.S. Cl. ..... 343/873; 343/700 MS; 343/702

(58) Field of Search ..... 343/700 MS, 702, 343/872, 873; 455/89, 90

(56) References Cited

U.S. PATENT DOCUMENTS 4,980,694 A * 12/1990 Hines ..... 343/702
5,943,019 A * 8/1999 Kawahata et al. ..... 343/702
6,028,555 A 2/2000 Harano ..... 343/702
6,061,028 A * 5/2000 Sakata ..... 343/702
6,100,849 A * 8/2000 Tsubaki et al. ..... 343/702
6,388,626 B1 * 5/2002 Gamalielsson et al. ..... 343/702
6,433,746 B2 * 8/2002 Kushihi et al. ..... 343/700 MS
6,470,174 B1 * 10/2002 Schefte et al. ..... 455/90

FOREIGN PATENT DOCUMENTS

| | | |
|---|---|---|
| GB | 2 345 196 A | 6/2000 |
| JP | 05-347507 | 12/1993 |
| JP | 11 046108 | 2/1999 |
| JP | 2000 151262 | 5/2000 |
| JP | 2000 209013 | 7/2000 |
| WO | WO 00/72404 | 11/2000 |

OTHER PUBLICATIONS

European Search Report. Application No. 02 00 0575. Date of Completion, Feb. 18, 2002.

* cited by examiner

*Primary Examiner*—Tan Ho
(74) *Attorney, Agent, or Firm*—Knobbe, Martens, Olson & Bear, LLP

(57) ABSTRACT

An antenna device includes a dielectric chip fitted to an aperture formed in an exterior casing of a terminal unit and having an outer surface thereof cooperating with an outer surface to form part of an outer surface of the terminal unit, and an antenna conductor embedded into the dielectric chip and disposed at a vertical position sufficiently far from a grounding conductor of a printed circuit board in the exterior casing.

10 Claims, 2 Drawing Sheets

PRIOR ART

ANTENNA DEVICE

BACKGROUND OF THE INVENTION

1. Technical Field

The present invention relates to an antenna device suited to be mounted in a small-sized terminal unit such as a cellular phone.

2. Related Art

A chip antenna has received much attention that is typically constituted by a rectangular-parallelopiped dielectric chip and a flat-plate-shaped or meander-shaped planar antenna embedded therein. As shown by way of example in FIG. 2, a chip antenna of this kind is mounted on a printed circuit board 1 with which the chip antenna is received inside an exterior casing 2 of the terminal unit.

In FIG. 2, reference numeral 3 denotes an antenna conductor; 4, a dielectric chip into which the antenna conductor 3 is embedded; 5*a*, a lead terminal led out from an end face of the antenna conductor 3 to the outside; and 5*b*, a fixture terminal. The chip antenna is mounted on the printed circuit board 1 by soldering the lead and fixture terminals 5*a*, 5*b* to prescribed portions of the printed circuit board.

Unlike a conventional rod antenna, the aforementioned antenna device or chip antenna has no projections projecting outwardly from the exterior casing. Thus, the antenna device is free from a bending failure and can improve the external appearance of the exterior casing, i.e., the terminal unit.

Since the chip antenna must be received in a limited space inside the exterior casing, outer dimensions of the chip antenna, in particular, its vertical position in the casing is considerably restricted. Specifically, the antenna conductor 3 is positioned at a limited or low vertical position relative to a grounding conductor (not shown) formed in the printed circuit board 1, making it difficult to heighten the vertical position for further improvement in antenna performance.

To improve the antenna performance, an attempt may be made to embed the antenna conductor 3 into the exterior casing 2 as shown in FIG. 3 so as to place the antenna conductor 3 at a higher vertical position relative to the grounding conductor (GND surface) of the printed circuit board 1. However, to embed the antenna conductor 3 in the exterior casing 2 made of plastic, which is generally fabricated by injection molding, a support mechanism must be provided in a molding die to support the antenna conductor 3 therein, requiring a complicated die structure. In addition, the fabrication process of the exterior casing 2 into which the antenna conductor 3 is embedded is also complicated, so that the finishing accuracy and hence the external appearance of the exterior casing may be degraded.

SUMMARY OF THE INVENTION

An object of the present invention is to provide an antenna device having an improved antenna performance and capable of being accommodated in a small-sized terminal unit such as a cellular phone, without degrading the external appearance of the terminal unit.

According to the present invention, an antenna device is provided, which comprises a dielectric chip adapted to be fitted in an aperture formed in an exterior casing of a terminal unit such as a cellular phone, the dielectric chip having an outer surface thereof cooperating with an outer surface of the exterior casing to form part of an outer surface of the terminal unit, and an antenna conductor embedded into the dielectric chip and extending along the outer surface of the dielectric chip.

With this invention, the dielectric chip of the antenna device is so disposed as to form part of the outer surface of a terminal unit, thereby permitting the antenna device to be accommodated inside the terminal unit without causing a degraded external appearance of the terminal unit, and the antenna conductor is embedded into the dielectric chip so as to extend along the outer surface of the dielectric chip, whereby the antenna conductor is placed sufficiently away from a grounding conductor of the terminal unit, to improve the antenna performance of the antenna device.

In the present invention, preferably, the antenna device is accommodated in the terminal unit having a printed circuit board that is disposed inside the exterior casing away from the aperture in the height direction of the exterior casing. Preferably, the antenna conductor embedded into the dielectric chip extends substantially in parallel to the outer surface of the dielectric chip, whereby the antenna conductor is placed at a vertical position sufficiently far from a grounding conductor that is formed, e.g., on the printed circuit board, to improve the antenna performance.

Preferably, the dielectric chip is provided with a fixture for fixing the dielectric chip to the printed circuit board. Alternatively, the dielectric chip is provided with a fixture for fixing the dielectric chip to the exterior casing. By fixing the dielectric chip of the antenna device, the antenna device is prevented from being unintentionally pushed further into the terminal unit to thereby prevent damages to the antenna device and components mounted on the printed circuit board.

DETAILED DESCRIPTION

[First Embodiment]

Figure 1:
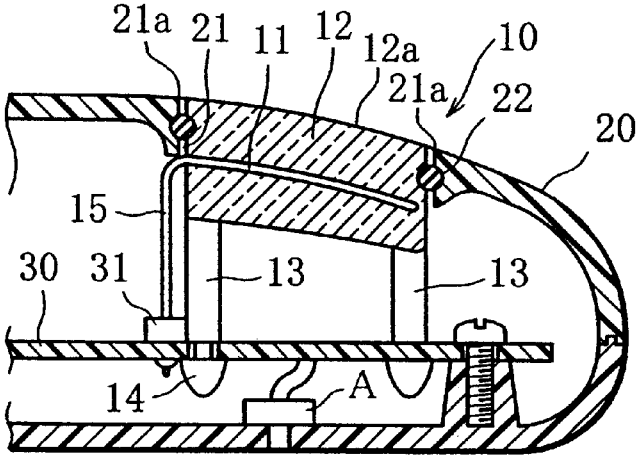
FIG. 1 is a schematic view showing an antenna device according to a first embodiment of the present invention, with the antenna device accommodated in a terminal unit.
Figure 2:
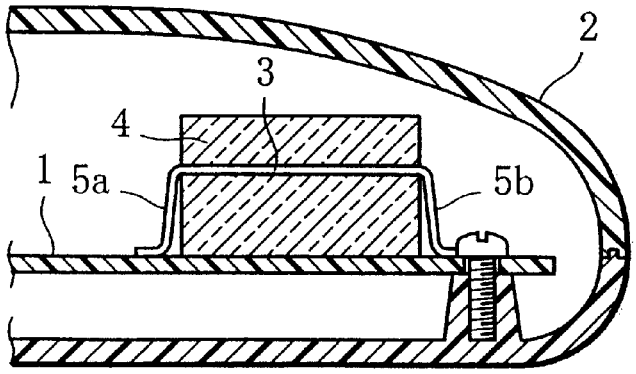
FIG. 2 is a view showing a conventional chip antenna accommodated in a terminal unit.

With reference to FIG. 1, an antenna device according to a first embodiment of this invention will be described.

The antenna device 10 of this embodiment is arranged to be accommodated in an exterior casing 20 of a terminal unit (in the present embodiment, a cellular phone), and has a planar antenna embedded in a dielectric chip 12. The planar antenna is constituted by an antenna conductor 11 formed into a flat-plate shape or a meander shape. The antenna device 10 is featured in that the dielectric chip 12 is fitted into an aperture 21 formed beforehand in the casing 20 of the terminal unit and has an outer surface 12*a* thereof disposed in flush with an outer surface of the casing 20 to form part of an outer surface of the terminal unit. Further, the antenna conductor 11 extends substantially in parallel with the outer surface 12*a* of the dielectric chip 12.

The outer surface 12*a* of the dielectric chip 12 cooperates with the outer surface of the casing 20 to provide the terminal unit with a continuous smooth external appearance when the chip 12 is fitted in the aperture 21 of the casing 20. More specifically, the outer surface 12*a* of the dielectric chip 12 forms a plane corresponding to a plane formed by an end edge 21*a* that defines the aperture 21 of the exterior casing 20. The antenna conductor 11, extending substantially in parallel to the outer surface 12*a* in the vicinity of the outer surface 12*a* of the dielectric chip 12, is placed at a vertical position sufficiently far from a grounding conductor (not shown) of a printed circuit board 30 disposed in the casing 20. To be noted, the aperture 21 into which the antenna device 10 is fitted is formed at a portion of the cellular phone that a user hardly touches. More specifically, the aperture 21 is formed on the back of a speaker A, i.e., on the upper back side of the cellular phone which is in use. The aperture 21 may be, of course, formed on the upper end side of the cellular phone, for instance.

Further, the dielectric chip 12 is provided at its lower face with legs 13 that serve as a fixture for mounting the antenna device 10 on the printed circuit board 30 and for supporting the antenna conductor 11 at a predetermined height from the circuit board 30. The legs 13 have distal ends thereof formed with wedge-shaped hooks 14. By inserting the hooks 14 into holes formed in the printed circuit board 30, the antenna device 10 is fixed to and supported above the printed circuit board 30, with the antenna conductor 11 of the antenna device 10 extending substantially in parallel to the circuit board 30.

The antenna conductor 11 is integrally formed at one end thereof with a lead terminal 15 that projects from one end surface of the dielectric chip 12 and then extends downward along one of the legs 13. When inserted into a connector 31 mounted beforehand on the printed circuit board 30, the lead terminal 15 is electrically connected therewith, so that electric power may be supplied to the antenna conductor 11 through the lead terminal 15, connector 31, and printed circuit board 30. Reference numeral 22 denotes a ring-shaped elastic member 22 that is interposed between the casing 20 and the dielectric chip 12 fitted in the aperture 21 of the casing 20, and serves to seal a gap between the casing and the dielectric chip. The elastic member 22 also serves to absorb a slight positional deviation between the antenna device 10 mounted to the printed circuit board 30 and the aperture 21 of the casing 20, thereby permitting the dielectric chip 12 to be fitted into the aperture 21 without causing a clearance therebetween. Moreover, the elastic member 22 decreases a force applied to the antenna device 10 through the casing 20, thereby preventing an undesired stress from generating in the antenna device 10.

Figure 3:
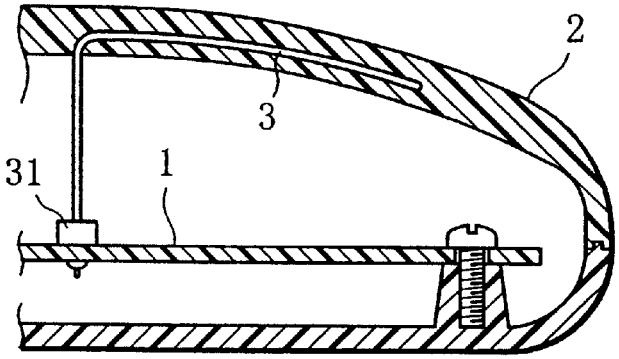
FIG. 3 PRIOR ART
FIG. 3 is a view showing by way of example an antenna device having an antenna conductor embedded into an exterior casing of a terminal unit.

With the antenna device 10 constructed as above, the antenna conductor 11 is positioned in the vicinity of the outer surface of the casing 20, i.e., at a sufficient height from the grounding conductor of the printed circuit board 30 accommodated in the casing 20, whereby the antenna performance is improved. Moreover, unlike the prior art arrangement wherein the antenna conductor is embedded into the casing as shown in FIG. 3, the casing 20 and the antenna device 10 can be fabricated independently of each other, thereby preventing a degraded external appearance of the casing which would be caused in the prior art casing by the antenna conductor embedded therein.

With the antenna device 10, the outer surface 12*a* of the dielectric chip 12 is exposed to the outside, however, differences between the casing 20 and the dielectric chip 12 such as an ingredient difference therebetween hardly constitute a cause of a degraded external appearance of the terminal unit since the exposed area is considerably small as compared to the entire surface area of the casing 20. Rather it is possible to improve the external appearance of the terminal unit by positively utilizing differences in material, surface treatment, and color between the casing 20 and the dielectric chip 12.

In a case where the dielectric chip 12 is different in material or color from the casing 20 to the extent that a user is well notified of the presence of the dielectric chip 12, the user is prevented from making actions to hinder the antenna performance, such as unintentionally holding the terminal unit by hand to cover the antenna device 10. Thus, it is expected that the antenna device 10 fully exhibits its antenna performance. Moreover, by using the dielectric chip made of a material having a dielectric constant higher than that of the casing 20, the antenna device 10 can be made compact in size. This makes it easy to mount the antenna device 10 in the cellular phone at such a portion that the user hardly covers the antenna device 10 by hand when he or she uses the phone. With such a cellular phone, the antenna performance is fully exhibited, whereby the quality of telecommunication is improved.

[Second Embodiment]

Figure 4:
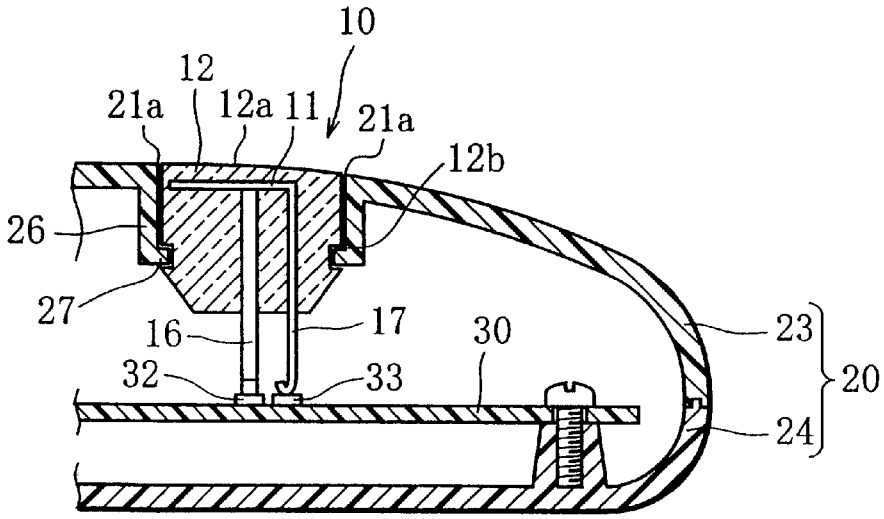
FIG. 4 is a schematic view showing an antenna device according to a second embodiment of the present invention.

With reference to FIG. 4, an antenna device according to a second embodiment of the present invention will be explained.

The antenna device of this embodiment mainly contemplates alleviating the accuracy of positioning the antenna device to a printed circuit board in an exterior casing of a terminal unit, thereby improving the ease of mounting to the terminal unit. As compared to the first embodiment fixed to the printed circuit board and using a connector to electrically connect the antenna conductor with the printed circuit board, the antenna device of this embodiment is different in that it is fixed to an inner surface of the exterior casing and uses terminal conductors for establishing electrical connection that extend from the antenna conductor and are in spring contact with pads on the printed circuit board.

As with the first embodiment, the antenna device 10 of this embodiment is adapted to be accommodated in a terminal unit such as a cellular phone, and the terminal unit has an exterior casing 20 consisting of upper and lower casings 23, 24, as shown in FIG. 4. The upper casing 23 is formed with an aperture 21 to which a dielectric chip 12 is fitted. A printed circuit board 30 is disposed inside the terminal unit and fixed to the lower casing 24.

The upper casing 23 of this embodiment has a wall 26 extending along the peripheral face of the dielectric chip 12 fitted in the aperture 21, and a hook 27 is formed in a lower end of the wall 26. A lower end portion of the dielectric chip 12 is tapered, so that the dielectric chip 12 can be easily fitted to the aperture 21, pressing away the hook 27. The dielectric chip 12 is fixed to the upper casing 23 when the hook 27 is fitted into a groove 12*b* formed in the peripheral face of the dielectric chip 12. The hook 27 of the exterior casing 20 cooperates with the groove 12*b* of the dielectric chip 12 to serve as a fixture for fixing the antenna device 10 to the inner surface of the exterior casing 20. Meanwhile, an elastic member corresponding to the element 22 shown in FIG. 1 may be provided between the dielectric chip 12 and the wall 26 of the exterior casing 20.

The antenna device 10 further comprises an antenna conductor 11, a power feed terminal 16, and short-circuiting terminal 17. These elements 11, 16 and 17 form an inverted F shape as a whole. The antenna conductor 11 is embedded within the dielectric chip 12 in the vicinity of the outer surface 12*a* of the dielectric chip and extends substantially in parallel to the outer surface 12*a*. The feed and short-circuiting terminals, i.e., the terminal conductors 16 and 17 are mostly embedded within the dielectric chip 12 to extend therethrough in the thickness direction of the dielectric chip 12. Lower portions of these terminals 16, 17 extend downwardly from the bottom face of the dielectric chip 12 toward the printed circuit board 20. When the dielectric chip 12 is fitted to the aperture 21 of the exterior casing 20, contact faces, i.e., distal end faces of the feed and short-circuiting terminals 16 and 17 are in spring contact with upper surfaces of pads 32 and 33 formed on a circuit pattern of the printed circuit board 30, respectively, making it possible to supply electric power to the antenna conductor 11 through the printed circuit board 30 and the feed terminal 16.

With the second embodiment, the dielectric chip 12 of the antenna device 10 is not fixed to the printed circuit board 30 but to the exterior casing 20, whereby the accuracy of positioning the antenna device 10 to the printed circuit board 30 is alleviated, making it easy to mount the antenna device 10 to the terminal unit. By widening the areas of the pads 32, 33, the accuracy of positioning the antenna device to the printed circuit board 30 can be further alleviated to achieve easy mounting.

The present invention is not limited to the foregoing embodiments. For instance, the size of the aperture 21 formed in the casing 20 may be determined in accordance with the size of the dielectric chip 12 of the antenna device 10, especially the wide of the outer surface 12*a* of the chip 12. The shape of the outer surface 12*a* of the dielectric chip 12 may be determined in accordance with the surface geometry of the casing 20 which accommodates the antenna device 10.

A space defined between the lower surface of the dielectric chip 12 and the printed circuit board 30 on which the antenna device 10 is mounted may be utilized for mounting other component parts of the terminal unit. Moreover, the dielectric chip 12 constituted by a transparent material may be employed together with a light emitting element disposed in the vicinity thereof and driven, e.g., by an electrical component mounted in the printed circuit board. In this case, the antenna device 10 can serve as an indicator for indicating operating modes of the terminal unit such as a cellular phone, for instance. Furthermore, a metal layer may be formed by plating or vapor deposition on the outer surface 12*a* or the bottom surface of the dielectric chip 12. Such a metal layer serves as a parasitic element for the antenna conductor 11 to improve the antenna performance.

In addition, the terminal unit into which the antenna device of the present invention is accommodated is not limited to a cellular phone, but may be a portable information terminal unit, personal computer, communication adapter and the like. Further, the present invention may be modified variously without departing from the scope of the invention.

The following inventive concepts can be comprehended from the foregoing embodiments.

(1) An antenna device which comprises a dielectric chip adapted to be fitted in an aperture formed in an exterior casing of a terminal unit, the dielectric chip having an outer surface thereof cooperating with an outer surface of the exterior casing to form part of an outer surface of the terminal unit, and an antenna conductor embedded into the dielectric chip and extending along the outer surface of the dielectric chip.

(2) The antenna device as set forth in (1), wherein the antenna device is accommodated in the terminal unit having a printed circuit board that is disposed inside the exterior casing away from the aperture in a height direction of the exterior casing.

(3) The antenna device as set forth in (1), wherein the antenna conductor embedded into the dielectric chip extends substantially in parallel to the outer surface of the dielectric chip.

(4) The antenna device as set forth in (2), wherein the dielectric chip is provided with a fixture for fixing the dielectric chip to the printed circuit board.

(5) The antenna device as set forth in (1), wherein the dielectric chip is provided with a fixture for fixing the dielectric chip to the exterior casing.

(6) The antenna device as set forth in (4), wherein the fixture consists of a leg extending from a surface of the dielectric chip on a side facing the printed circuit board, and the leg is formed with a hook adapted to be inserted into a hole formed in the printed circuit board.

(7) The antenna device as set forth in (1), further comprising an elastic member interposed between the dielectric chip and the exterior casing to seal a gap therebetween.

(8) The antenna device as set forth in (4), wherein the dielectric chip has a peripheral face thereof formed with a groove, and the exterior casing has a wall extending along the peripheral face of the dielectric chip, the wall having a hook inserted into the groove of the dielectric chip.

(9) The antenna device as set forth in (8), further comprising a terminal conductor extending from the antenna conductor to outside of the dielectric chip, the terminal conductor has a contact face adapted to be in spring contact with a pad formed on the printed circuit board.

(10) The antenna device as set forth in (1), wherein the dielectric chip is so disposed that the outer surface thereof is in flush with the outer surface of the exterior casing.

(11) A terminal unit to which the antenna device as set forth in any one of (1)–(10) is mounted.

What is claimed is:

1. An antenna device comprising:

a dielectric chip adapted to be fitted in an aperture formed in a part of an exterior casing of a terminal unit, said dielectric chip having an outer surface thereof cooperating with an outer surface of the exterior casing to form part of an outer surface of the terminal unit, which is opposed to a printed circuit board accommodated in the exterior casting; and an antenna conductor embedded into said dielectric chip and extending along the outer surface of said dielectric chip.

2. The antenna device according to claim 1, wherein said antenna device is accommodated in the terminal unit having a printed circuit board that is disposed inside the exterior casing away from the aperture in a height direction of the exterior casing.

3. The antenna device according to claim 2, wherein said dielectric chip is provided with a fixture for fixing said dielectric chip to the printed circuit board.

4. The antenna device according to claim 3, wherein said fixture consists of a leg extending from a surface of said dielectric chip on a side facing the printed circuit board, and the leg is formed with a hook adapted to be inserted into a hole formed in the printed circuit board.

5. The antenna device according to claim 3, wherein said dielectric chip has a peripheral face thereof formed with a groove, and the exterior casing has a wall extending along the peripheral face of said dielectric chip, the wall having a hook inserted into the groove of said dielectric chip.

6. The antenna device according to claim 5, further comprising a terminal conductor extending from said antenna conductor to outside of said dielectric chip, said terminal conductor has a contact face adapted to be in spring contact with a pad formed on the printed circuit board.

7. The antenna device according to claim 1, wherein said antenna conductor embedded into said dielectric chip extends substantially in parallel to the outer surface of said dielectric chip.

8. The antenna device according to claim 1, wherein said dielectric chip is provided with a fixture for fixing said dielectric chip to the exterior casing.

9. The antenna device according to claim 1, further comprising an elastic member interposed between said dielectric chip and the exterior casing to seal a gap therebetween.

10. The antenna device according to claim 1, wherein said dielectric chip is so disposed that the outer surface thereof is in flush with the outer surface of the exterior casing.

* * * * *